US006082974A

United States Patent [19]

Takemoto et al.

[11] Patent Number: 6,082,974

[45] Date of Patent: Jul. 4, 2000

[54] LIQUID-COOLED COMPACT MOTOR PUMP

[75] Inventors: Yoshihiro Takemoto, Nittagun; Toru Murakami, Kiryu, both of Japan

[73] Assignee: Mitsuba Corporation, Kiryu, Japan

[21] Appl. No.: 08/799,811

[22] Filed: Feb. 13, 1997

[30] Foreign Application Priority Data

Mar. 18, 1996 [JP] Japan ..... 8-088846

[51] Int. Cl.[7] ..... F04B 17/03; F04B 39/06

[52] U.S. Cl. ..... 417/366; 417/423.7; 417/423.12; 417/423.14

[58] Field of Search ..... 417/423.14, 36, 417/360, 366, 423.7, 423.12

[56] References Cited

U.S. PATENT DOCUMENTS

| | | | |
|---|---|---|---|
| 5,151,016 | 9/1992 | Her | 417/32 |
| 5,350,039 | 9/1994 | Voss et al. | 184/6.16 |
| 5,700,138 | 12/1997 | Bevington | 417/366 |
| 5,720,599 | 2/1998 | Myers | 417/360 |

*Primary Examiner*—John J. Vrablik
*Attorney, Agent, or Firm*—Oliff & Berridge, PLC

[57] ABSTRACT

A motor pump includes a motor, a controller and an impeller assembly. The motor has a motor casing with a first end. The controller is operative to control rotation of the motor. The impeller assembly is operably connected to the motor and is enclosed within a pump casing that is connected to the first end of the motor. The pump casing includes a chamber sized to a accommodate the controller.

11 Claims, 3 Drawing Sheets

LIQUID-COOLED COMPACT MOTOR PUMP

BACKGROUND OF THE INVENTION

1. Field of Invention

The present invention relates to a motor pump for supplying and discharging fluid such as water and the like.

2. Description of Related Art

In general, many motor pumps have a pump unit mounted to the extreme end of a motor shaft projecting from a motor casing through a seal member. Some motor pumps employ a so-called "brushless electric motor" having a stator coil disposed at an inner periphery of a motor casing as a motor unit. Conventionally, this type of motor pump has a motor unit as shown in FIG. 3 that includes a motor shaft 17 projecting from a motor casing 16 as well as an accommodation chamber 19. A controller 18 for controlling a magnetic field of the stator coil is disposed within the accommodation chamber 19 that is located in a base end of the motor casing 16. For simplicity of illustration, the pump unit is not mounted to an end of the motor shaft 17 in FIG. 3.

Since the conventional motor pump must cope with heat generated by the controller 18, the motor pump must cool the controller 18 by having a large radiation fin 19*a* formed in the accommodation chamber 19. However, since the accommodation chamber 19 requires space for forming the radiation fin 19*a* in addition to an intrinsically necessary space required for this arrangement, this design prevents the reduction of weight and size of the motor pump. Further, when the radiation fin 19*a* is intended to dissipate heat generated by the motor unit, the size of the motor pump is further increased. Thus, there is a problem associated with reduction of weight and size of the motor pump when the radiation fin 19*a* is used to cool, i.e. dissipate heat, generated by the controller 18 and/or the motor unit. The present invention resolves this problem.

SUMMARY OF THE INVENTION

According to the present invention made to solve the above problems taking the aforesaid circumstances into consideration, a motor pump has a pump casing mounted to an end surface of a motor casing whereby an accommodation chamber for accommodating a controller for controlling the drive of a motor is disposed on the pump casing.

With this arrangement, the heat radiated from the accommodation chamber can be cooled by a fluid flowing in the pump without the need of a radiation fin or other member exclusively used for cooling. Now, the weight and size of the motor pump can be reduced. In the present invention arranged as described above, the motor may be a brushless motor.

In the present invention, the accommodation chamber is located adjacent to an inflow passage and an outflow passage of a pump casing disposed on the motor casing. With this arrangement, the accommodation chamber can be cooled by the fluid flowing through the inflow and outflow passages, so that a radiation fin or other member exclusively used for cooling the accommodation chamber need not be provided.

In the present invention, the accommodating chamber may be positioned between the inflow passage and the outflow passage of the pump casing so that cooling of the accommodation chamber can be more enhanced.

Further, according to the present invention, the motor shaft projecting portion of the motor casing is formed with a recess portion and a pump member can be received by the recess portion of the casing, which, in turn, the weight and size of the motor pump can be reduced.

Additionally, according to the present invention, the core shaft of the motor casing is journaled at the recess portion of the casing through a bearing interposed between the recess portion of the casing which is received in a core recess portion formed to a rotor core connected to the core shaft. Thus, the weight and size of the motor pump can be further reduced.

DETAILED DESCRIPTION OF PREFERRED EMBODIMENTS

Figure 1:
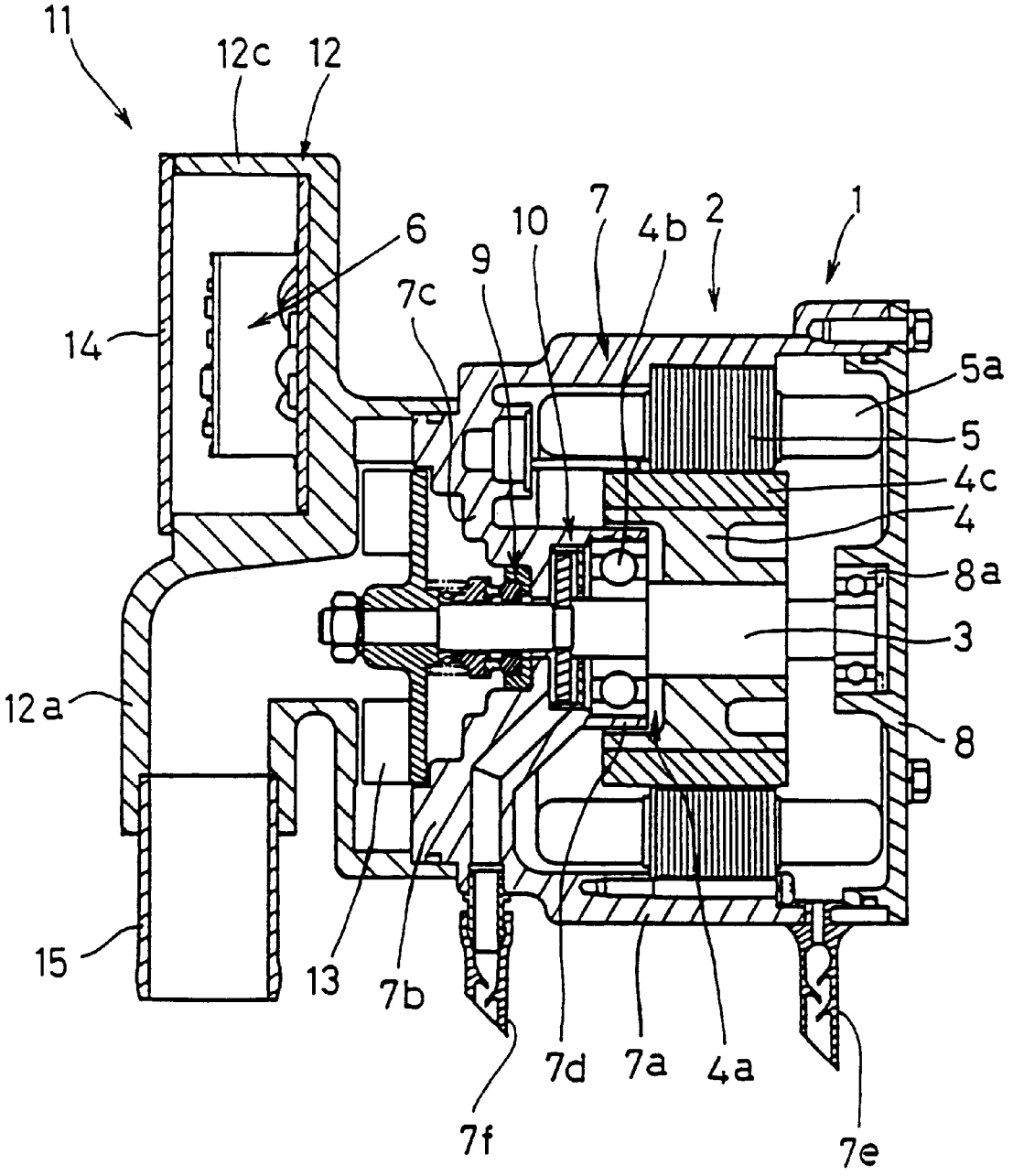
FIG. 1 is a cross sectional view of a motor pump of the present invention.
Figure 2:
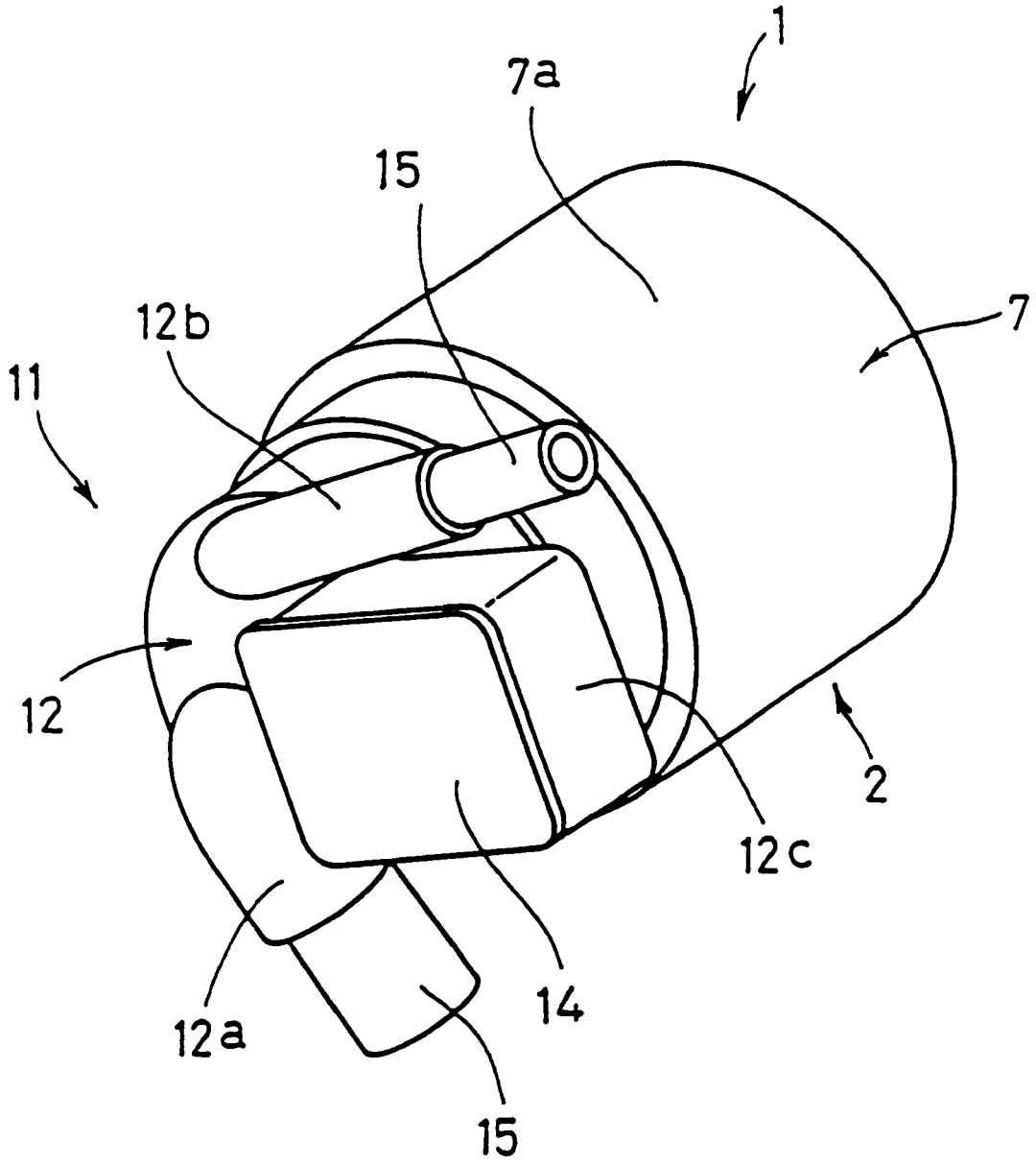
FIG. 2 is a perspective view of the motor pump of the present invention.

Next, a preferred embodiment of the present invention will be described based on the drawings. In the drawings, a brushless motor constituting a motor pump 1 pumps, for example, water or other types of fluid. Although water is used throughout the description of the preferred embodiment, one of ordinary skill in the art would appreciate that any fluid, particularly a liquid fluid, could be used as a substitute therefor. The brushless motor 1 includes a motor casing 2 which is described in more detail below, a core shaft 3 journaled by the casing 2, a rotor core 4 integrally connected with the core shaft 3 and having a permanent magnet 4*c* fixedly secured to the outer periphery thereof, a stator coil 5*a* wound around a stator core 5 disposed within the inner periphery of the motor casing 2 and a controller 6 for controlling the magnetic field of the stator coil 5*a* similar to conventional brushless motors.

The motor casing 2 is composed of a bottomed cylindrical case main body 7 composed of a cylindrical portion 7*a* to which the stator core 5*a* is fixed and an end surface portion (bottom portion) 7*b* formed at an end of the cylindrical portion 7*a* and an end bracket 8 for covering an opened end of the case main body 7 on a base end side thereof. A recess portion 7*c* which is recessed inwardly toward the center of the motor in a stepwise manner is formed at the end surface portion 7*b*, a cylindrical journal 7*d* projects from an inside end edge of the recess portion 7*c* toward the rotor core 4, an end of the journal 7*d* on a side of the rotor core 4 is inserted into a core recess portion 4*a* formed to the rotor core 4 and a bearing 4*b* is interposed between an inner cylindrical surface of the journal 7*d* and an outer periphery of the core shaft 3 in a state whereby it overlaps the core recess portion 4*a*.

Note, a base end of the core shaft 3 is journaled by an end bracket 8 through a bearing 8*a*. Numerals 9, 10 denote first and second seal elements for preventing water supplied and discharged by a motor unit 11, which is described below, from penetrating into the motor casing 2. Further, numeral 7*e* in the drawing denotes a first water discharge tube for discharging water infiltrating the motor casing 2 and numeral 7*f* denotes a second water discharge tube for discharging water infiltrating the second seal element 10.

A pump casing 12 is a component of the pump unit 11. The pump casing 12 is formed with a bottomed cylindrical shape with an opened end, an end edge of the opened end contacts the end surface portion 7*b* of the case main body 7 so as to accommodate an impeller 13 fixedly secured to the core shaft 3 projecting from the end surface portion 7*b* of the case main body 7 into the pump casing 12 as well as a water inflow passage 12*a* and a water outflow passage 12*b* are formed in an end surface of the pump casing 12 in an extending fashion. A water pump is arranged such that water supplied from a water source and drawn into the inflow passage 12*a* by an impeller 13 driven by the motor. Thereafter, water forcibly flows out from the outflow passage 12*b*. An accommodation chamber 12*c* is formed at the end surface of the pump casing 12 and is positioned in a vicinity between the inflow passage 12*a* and the outflow passage 12*b*. The controller 6 for controlling the magnetic field of the stator coil 5 is accommodated in the pump casing 12. The accommodation chamber 12*c* is sized so it does not extend beyond the inflow and outflow passages 12*a*, 12*b* as viewed along the axial direction, i.e. in the direction of the core shaft 3. Also, the accommodation chamber 12*c* is further sized so as not to project beyond the extreme ends of the inflow and outflow passages 12*a*, 12*b* in the radial direction relative to the core shaft 3. Thus, the accommodation chamber 12*c* is protected by the inflow and outflow passages 12*a*, 12*b*.

A cover 14 covers the accommodation chamber 12*c* and nipple elements 15 connect to each of the inflow and outflow passages 12*a*, 12*b*.

Figure 3:
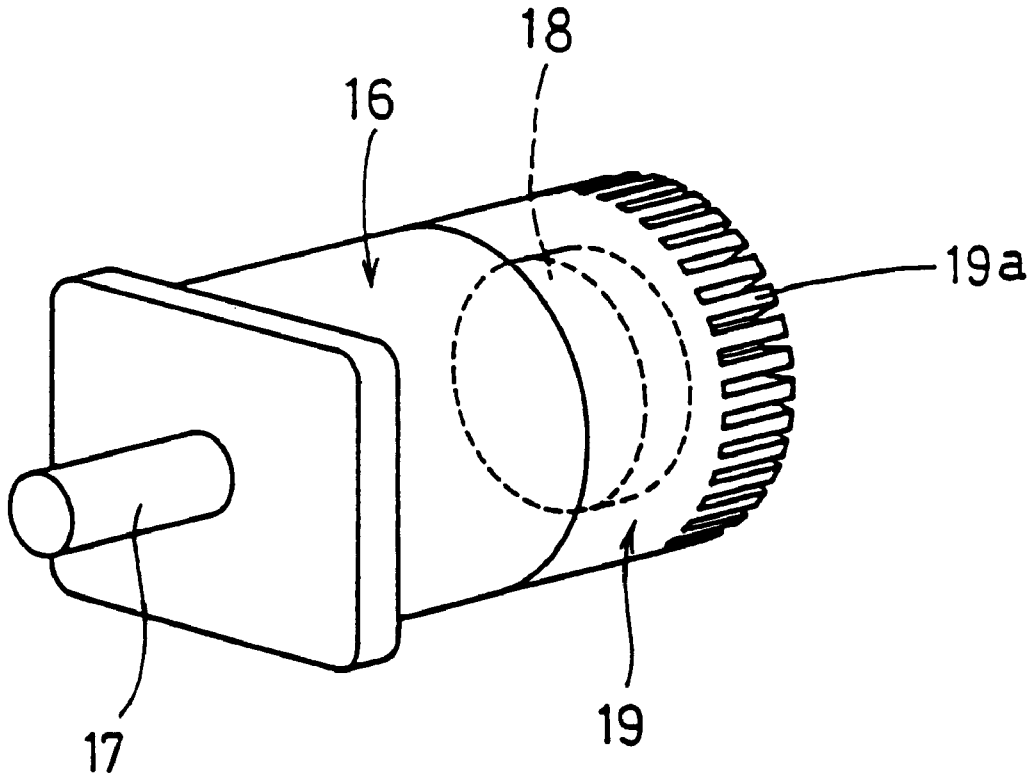
FIG. 3 RELATED ART
FIG. 3 is a perspective view of a conventional motor pump shown without a pump unit.

In the preferred embodiment of the present invention as described above, the rotor core 4 of the brushless motor 1 constituting the motor pump is rotated by controlling the magnetic field of the stator core 5*a* in response to a control command from the controller 6 to thereby drive the pump unit 11. In this preferred embodiment of the present invention, the controller 6 for controlling the drive of the brushless motor 1 is disposed in the accommodation chamber 12*c* formed in the pump casing 12. As a result, since the controller 6 is subjected to a cooling action achieved by water flowing through the pump unit 11 as a coolant (i.e., cooling water), a radiation fin need not be provided for cooling which differs from a conventional accommodation chamber disposed in the motor casing as shown in FIG. 3. Thus, the accommodation chamber 12*c* can be made compact.

As described above, the controller 6 for controlling the drive of the brushless motor 1 is disposed in the accommodation chamber 12*c* formed integrally in the pump casing 12 of the motor pump in which the present invention is embodied and subjected to cooling action by the water flowing in the pump. Further, since the accommodation chamber 12*c* is disposed between the inflow passage 12*a* and the outflow passage 12*b*, the accommodation chamber 12*c* is also subjected to the cooling action by water flowing thereby. As a result, the cooling effect of the controller 6 can be more enhanced.

Moreover, since the accommodation chamber 12*c* can be formed by effectively making use of a vacant space between the inflow passage 12a and the outflow passage 12*b* in the preferred embodiment of the present invention, the size of the motor pump can be reduced in the axial direction thereof and, thus, the weight of the motor pump can also be reduced.

In the preferred embodiment of the present invention, the core shaft 3 is journaled by the case main body 7 which is located at the position where it is received by the core recess portion 4*a*. This achieves an advantage of making the motor pump more compact by being combined with the recess portion 7*c* being formed at the end surface portion 7*b* of the case main body 7 so as to accommodate the seal elements 9, 10 and other components of the pump therein.

Further, since one side of the motor is enclosed by the end surface portion 7*b* of the case main body 7 and the pump casing 12 in the preferred embodiment of the present invention, a separate case member is not necessary to enclose the one side of the motor pump. Thus, the weight and size of the motor pump can be further reduced and the structure thereof can be simplified. Furthermore, since the brushless motor 1 itself is located adjacent to the pump unit only through the end surface portion 7*b*, it can be subjected to the cooling action of the flowing water.

What is claimed is:

1. A motor pump for supplying and discharging a liquid, comprising:

a motor having a motor casing with a first end;

a controller operative to control rotation of the motor; and an impeller assembly operably connected to said motor and enclosed within a pump casing connected to said first end of said motor casing, said pump casing including a chamber in which the controller is mounted.

2. A motor pump according to claim 1, wherein said motor is a brushless motor.

3. A motor pump according to claim 1, wherein said pump casing includes an inflow passage member and an outflow passage member being in fluid communication with each other whereby at least one of said inflow passage member and said outflow passage member is disposed adjacent said chamber.

4. A motor pump according to claim 3, wherein said chamber is generally disposed between said inflow passage member and outflow passage member.

5. A motor pump according to claim 1, wherein said motor casing includes a recessed end portion in which at least a portion of said impeller assembly is seated.

6. A motor pump according to claim 5, wherein said motor includes a core shaft journaled on a bearing assembly connected to said recessed end portion of said motor casing.

7. A motor pump according to claim 6, wherein said motor includes a rotor core rotatably disposed within said motor casing about a rotational axis, a cavity formed into said rotor core about the rotational axis and sized to receive a cylindrical journal portion projecting from an inside end edge of said recessed end portion.

8. A pump casing, comprising:

a body member sized and adapted to be connected to an end of a motor, said body member including an inflow passage member and an outflow passage member being in fluid communication with each other interiorly of said body member and a chamber being in fluid isolation from said inflow and outflow passage members and opening exteriorly of said body member, whereby at least one of said inflow passage member and said outflow passage member is disposed adjacent said chamber.

9. A pump casing according to claim 8, wherein said chamber is generally disposed between said inflow passage member and said outflow passage member.

10. A motor casing adapted for use to enclose a motor of a motor pump used for supplying and discharging a liquid and having a core shaft connected to an impeller assembly, the motor casing comprising:

a recessed end portion disposed about an axis of rotation and extending inwardly relative to the motor casing, at least a portion of the impeller assembly positioned within the recessed end portion, wherein said recessed end portion includes a cylindrical journal portion projecting from an inside end edge of the recessed end portion so that a cavity formed in a rotor core rotatable disposed within the motor casing about a rotational axis receives the cylindrical journal portion.

11. A motor casing according to claim 10, wherein said recessed end portion includes a bearing assembly to journal the core shaft.

* * * * *